US008128173B2

(12) United States Patent
Huang

(10) Patent No.: US 8,128,173 B2
(45) Date of Patent: Mar. 6, 2012

(54) CHAIR THAT IS ASSEMBLED AND DISASSEMBLED EASILY AND QUICKLY

(76) Inventor: Su-Nu Huang, Dongguan (CN)

( * ) Notice: Subject to any disclaimer, the term of this patent is extended or adjusted under 35 U.S.C. 154(b) by 193 days.

(21) Appl. No.: 12/577,904

(22) Filed: Oct. 13, 2009

(65) Prior Publication Data

US 2011/0084536 A1 Apr. 14, 2011

(51) Int. Cl.
*A47C 7/00* (2006.01)

(52) U.S. Cl. ..... 297/440.15; 297/440.14; 297/440.1

(58) Field of Classification Search ..... 297/440.1, 297/440.14, 440.15, 440.2, 440.23
See application file for complete search history.

(56) References Cited

U.S. PATENT DOCUMENTS 2,650,657 A * 9/1953 Ohlsson ..... 297/440.23
3,233,942 A * 2/1966 Creutz ..... 297/463.2
5,407,250 A * 4/1995 Prince et al. ..... 297/440.2 X
6,494,540 B1 * 12/2002 Tornero ..... 297/440.1
7,296,859 B1 * 11/2007 Branch, III ..... 297/440.23 X

* cited by examiner

*Primary Examiner* — Anthony D Barfield
(74) *Attorney, Agent, or Firm* — Alan Kamrath; Kamrath IP Lawfirm, PA

(57) ABSTRACT

A chair includes a backrest frame, an armrest frame detachably mounted on the backrest frame and a seat frame detachably mounted between the backrest frame and the armrest frame. Thus, the seat frame and the backrest frame are combined together easily and quickly so that a user can assemble and disassemble the chair by himself without needing aid of any hand tool, thereby facilitating the user assembling and disassembling the chair. In addition, the armrest frame, the seat frame and the backrest frame are detached from and laminated with each other before assembly so as to reduce the whole volume of the chair and to decrease the cost of packaging, storage and transportation of the chair.

12 Claims, 4 Drawing Sheets

CHAIR THAT IS ASSEMBLED AND DISASSEMBLED EASILY AND QUICKLY

BACKGROUND OF THE INVENTION

1. Field of the Invention

The present invention relates to a chair and, more particularly, to a chair that can be detached in parts.

2. Description of the Related Art

A conventional chair comprises a support, a seat secured on the top of the support and a backrest secured on and located above the seat. However, the conventional chair has a fixed structure and cannot be detached in parts before assembly so that the conventional chair occupies a larger volume when not in use, thereby increasing the cost of packaging, storage and transportation of the chair. In addition, the conventional chair cannot be assembled easily and quickly.

BRIEF SUMMARY OF THE INVENTION

In accordance with the present invention, there is provided a chair, comprising a backrest frame, an armrest frame detachably mounted on the backrest frame and a seat frame detachably mounted between the backrest frame and the armrest frame.

The armrest frame includes two side support racks each detachably mounted on the backrest frame. Each of the two side support racks of the armrest frame has a first section detachably mounted on the backrest frame and a second section which is perpendicular to the first section and detachably connected with the seat frame.

The first section of each of the two side support racks has an end face provided with a screw bore, the backrest frame is provided with two fixing holes each aligning with the screw bore of the respective side support rack, and the chair further comprises two threaded fastening knobs each extending through a respective one of the fixing holes of the backrest frame and each screwed into the screw bore of the respective side support rack so that the first section of each of the two side support racks is releasably locked onto the backrest frame.

The second section of each of the two side support racks has an inner side provided with a fixing block, the backrest frame has a front side provided with two positioning blocks, and the seat frame has four corners supported by the fixing block of each of the two side support racks and the two positioning blocks of the backrest frame.

The seat frame has a bottom provided with four threaded tubes inserted into the fixing blocks of the two side support racks and the two positioning blocks of the backrest frame respectively, and the chair further comprises four threaded locking knobs screwed into the threaded tubes of the seat frame respectively and abutting the fixing blocks of the two side support racks and the two positioning blocks of the backrest frame respectively so that the seat frame is releasably locked onto the fixing blocks of the two side support racks and the two positioning blocks of the backrest frame.

The fixing block of each of the two side support racks is provided with a fixing hole, each of the positioning blocks of the backrest frame is provided with a positioning hole, and the threaded tubes of the seat frame are fixed in the fixing holes of the fixing blocks and the positioning holes of the positioning blocks respectively.

The primary objective of the present invention is to provide a chair that is assembled and disassembled easily and quickly.

Another objective of the present invention is to provide a chair that is folded and detached before assembly so as to decrease the cost of packaging, storage and transportation.

According to the primary objective of the present invention, the armrest frame, the seat frame and the backrest frame are combined together easily and quickly by operation of the threaded locking knobs and the threaded fastening knobs so that a user can assemble and disassemble the chair by himself without needing aid of any hand tool, thereby greatly facilitating the user assembling and disassembling the chair.

According to another objective of the present invention, the armrest frame, the seat frame and the backrest frame are detached from and laminated with each other before assembly so as to reduce the whole volume of the chair and to decrease the cost of packaging, storage and transportation of the chair.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
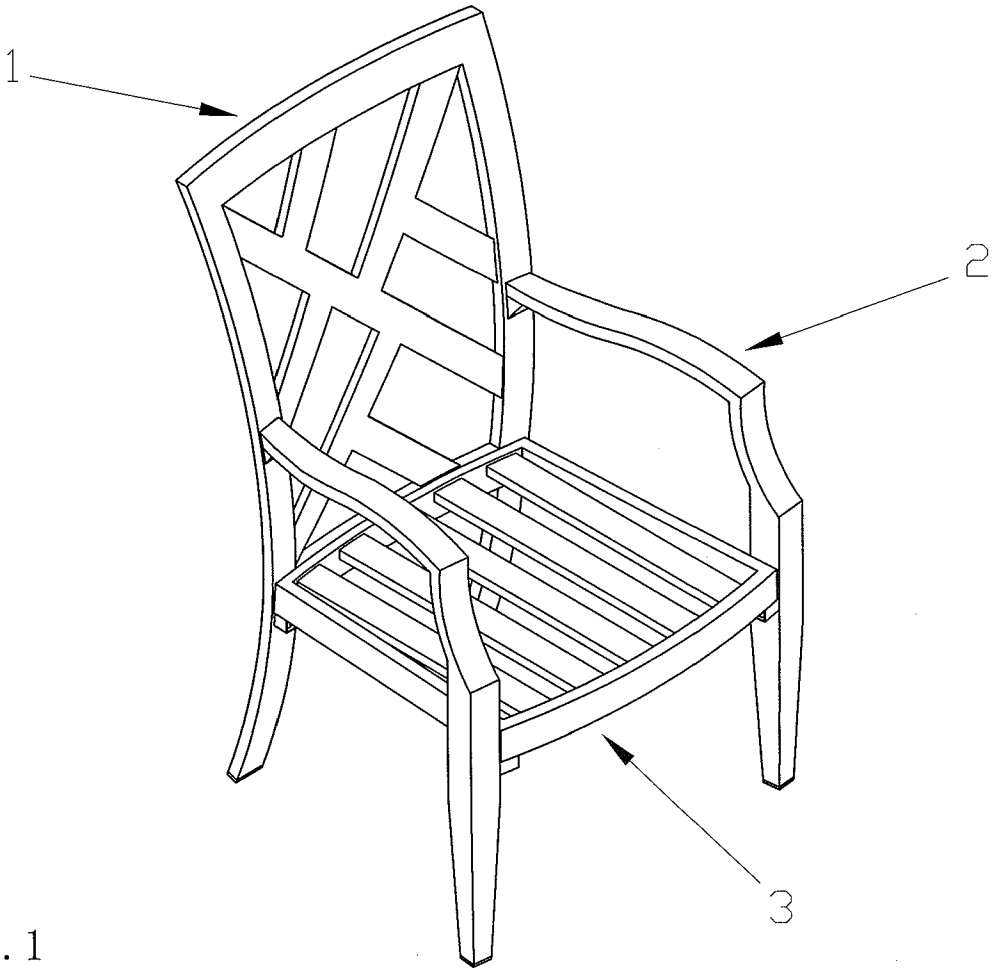
FIG. 1 is a perspective view of a chair in accordance with the preferred embodiment of the present invention.
Figure 2:
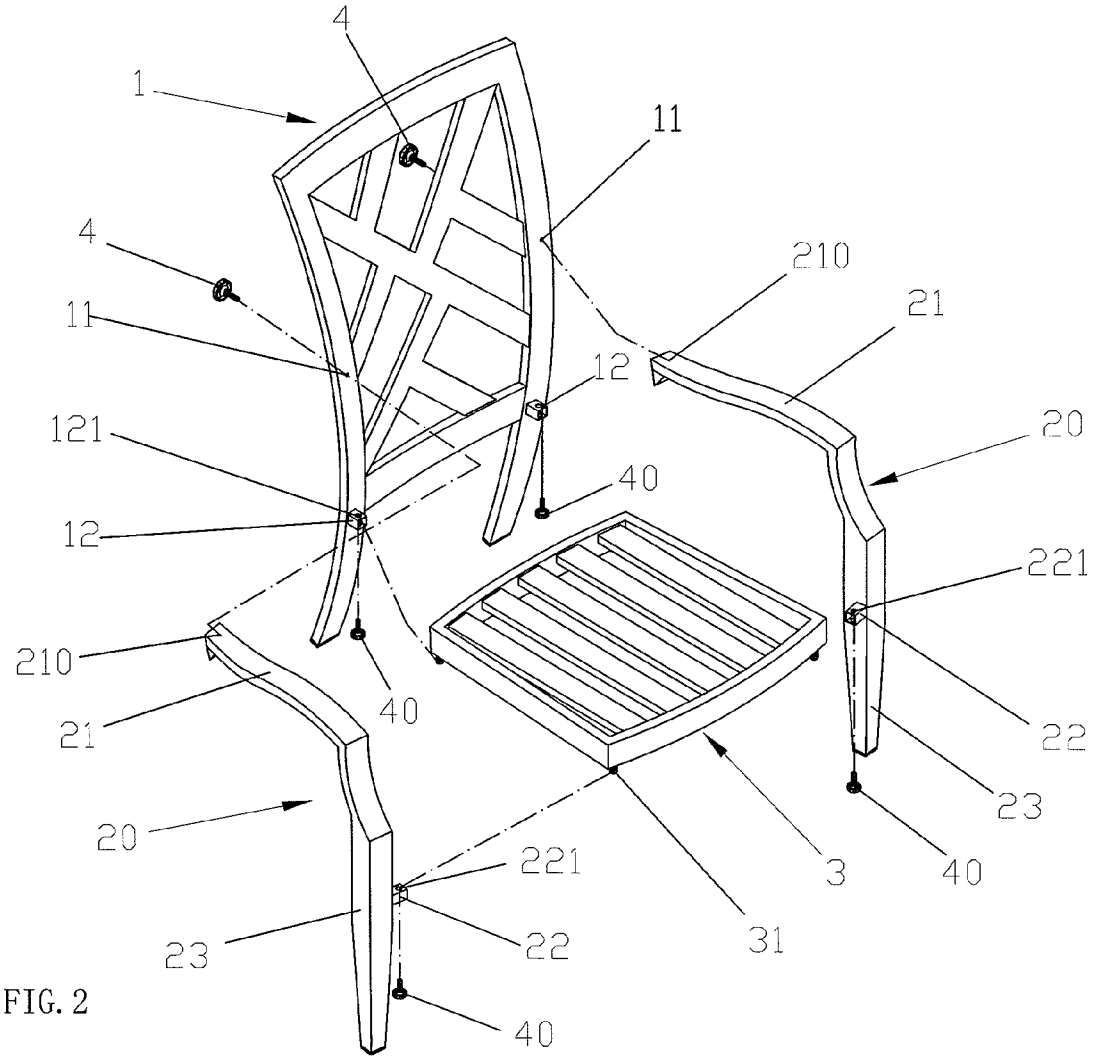
FIG. 2 is an exploded perspective view of the chair as shown in FIG. 1.

Referring to the drawings and initially to FIGS. 1 and 2, a chair in accordance with the preferred embodiment of the present invention comprises a backrest frame 1, an armrest frame 2 detachably mounted on the backrest frame 1, and a seat frame 3 detachably mounted between the backrest frame 1 and the armrest frame 2.

The armrest frame 2 includes two side support racks 20 each detachably mounted on the backrest frame 1. Each of the two side support racks 20 of the armrest frame 2 is a sheet plate and has a substantially inverted L-shaped profile. Each of the two side support racks 20 of the armrest frame 2 has a first section 21 detachably mounted on the backrest frame 1 and a second section 23 which is perpendicular to the first section 21 and detachably connected with the seat frame 3. The first section 21 of each of the two side support racks 20 has an end face provided with a screw bore 210. The second section 23 of each of the two side support racks 20 has an inner side provided with a fixing block 22. The fixing block 22 of each of the two side support racks 20 is mounted on a middle position of the second section 23. The fixing block 22 of each of the two side support racks 20 is provided with a fixing hole 221.

The backrest frame 1 is a sheet plate and has a substantially inverted U-shaped profile. The backrest frame 1 is detachably mounted between the two side support racks 20 of the armrest frame 2. The backrest frame 1 is provided with two fixing holes 11 each aligning with the screw bore 210 of the respective side support rack 20, and the chair further comprises two threaded fastening knobs 4 each extending through a respective one of the fixing holes 11 of the backrest frame 1 and each screwed into the screw bore 210 of the respective side support rack 20 so that the first section 21 of each of the two side support racks 20 is releasably locked onto the backrest frame 1. Each of the fixing holes 11 of the backrest frame 1 is formed on an upper portion of the backrest frame 1. The backrest frame 1 has a front side provided with two positioning blocks 12. The positioning blocks 12 of the backrest frame 1 is mounted on a lower portion of the backrest frame 1. Each of the positioning blocks 12 of the backrest frame 1 is provided with a positioning hole 121.

The seat frame 3 is a sheet plate and has a substantially square profile. The seat frame 3 is located between the two side support racks 20 of the armrest frame 2 and has four corners supported by the fixing block 22 of each of the two side support racks 20 and the two positioning blocks 12 of the backrest frame 1. The seat frame 3 has a bottom provided with four threaded tubes 31 inserted into the fixing blocks 22 of the two side support racks 20 and the two positioning blocks 12 of the backrest frame 1 respectively, and the chair further comprises four threaded locking knobs 40 screwed into the threaded tubes 31 of the seat frame 3 respectively and abutting the fixing blocks 22 of the two side support racks 20 and the two positioning blocks 12 of the backrest frame 1 respectively so that the seat frame 3 is releasably locked onto the fixing blocks 22 of the two side support racks 20 and the two positioning blocks 12 of the backrest frame 1. The threaded tubes 31 of the seat frame 3 are fixed in the fixing holes 221 of the fixing blocks 22 and the positioning holes 121 of the positioning blocks 12 respectively.

Figure 3:
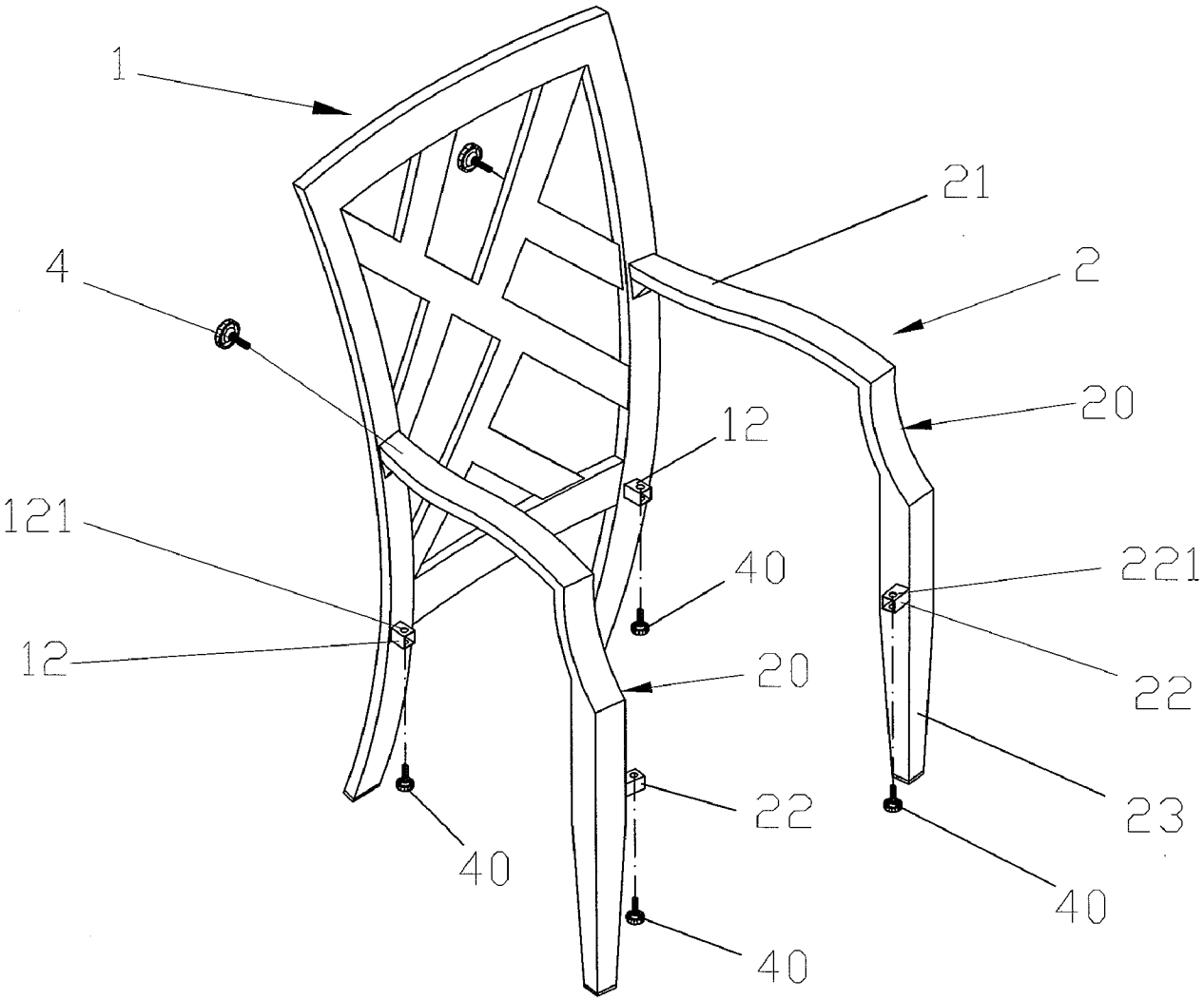
FIG. 3 is a partially exploded perspective assembly view of the chair as shown in FIG. 1.
Figure 4:
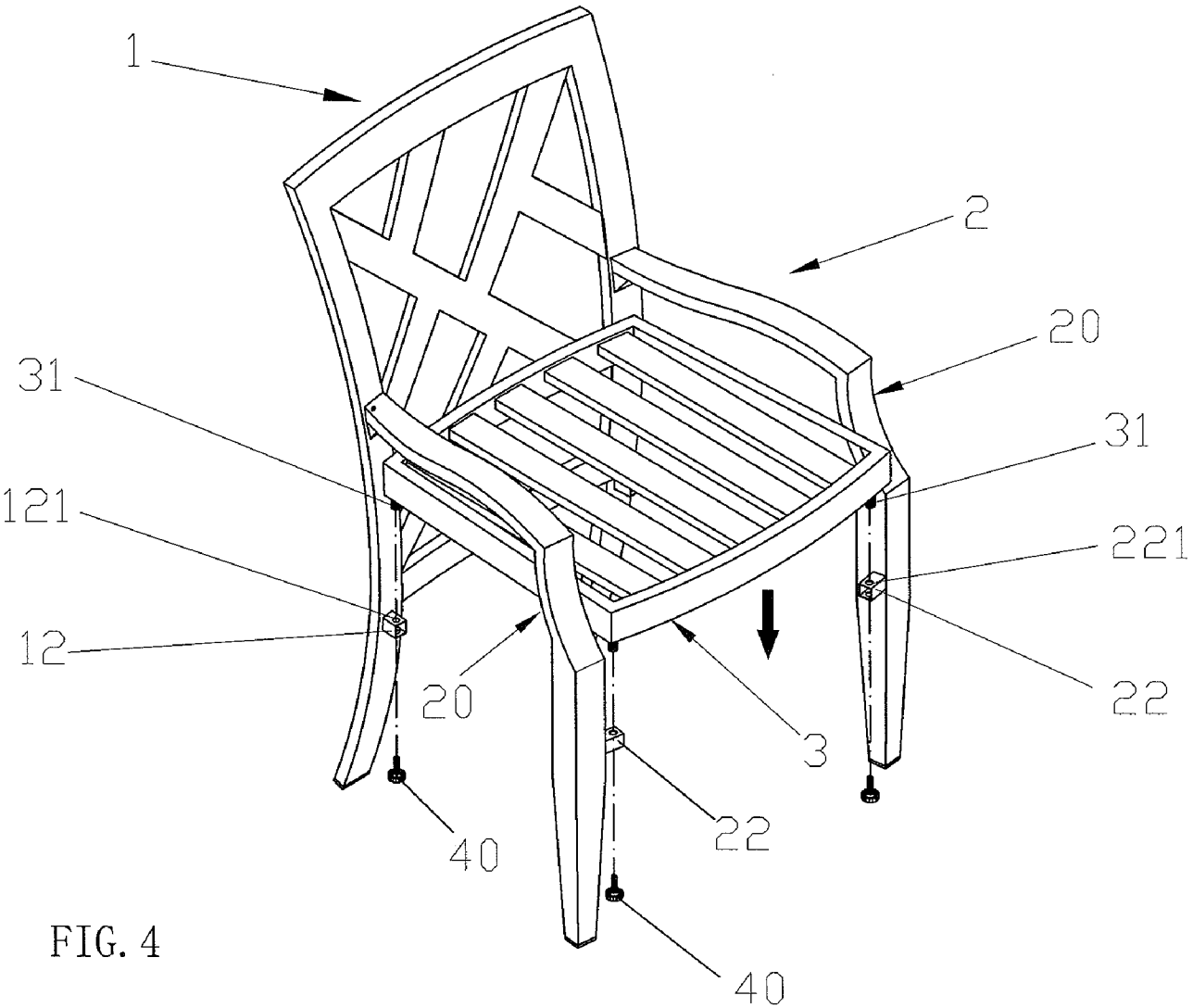
FIG. 4 is a partially exploded perspective assembly view of the chair as shown in FIG. 1.

In assembly, referring to FIGS. 1-4, each of the two threaded fastening knobs 4 is extended through the respective fixing hole 11 of the backrest frame 1 and is screwed into the screw bore 210 of the respective side support rack 20 so that the first section 21 of each of the two side support racks 20 is locked onto the backrest frame 1 as shown in FIG. 3 so as to combine the armrest frame 2 and the backrest frame 1 together. Then, the seat frame 3 is moved toward the fixing blocks 22 of the two side support racks 20 and the two positioning blocks 12 of the backrest frame 1 as shown in FIG. 4 until the seat frame 3 abuts the fixing blocks 22 of the two side support racks 20 and the two positioning blocks 12 of the backrest frame 1. Finally, the four threaded locking knobs 40 are screwed into the threaded tubes 31 of the seat frame 3 respectively and abut the fixing blocks 22 of the two side support racks 20 and the two positioning blocks 12 of the backrest frame 1 respectively so that the seat frame 3 is locked onto the fixing blocks 22 of the two side support racks 20 and the two positioning blocks 12 of the backrest frame 1 so as to combine the seat frame 3, the armrest frame 2 and the backrest frame 1 together. Thus, the chair is assembled as shown in FIG. 1.

Accordingly, the armrest frame 2, the seat frame 3 and the backrest frame 1 are combined together easily and quickly by operation of the threaded locking knobs 40 and the threaded fastening knobs 4 so that a user can assemble and disassemble the chair by himself without needing aid of any hand tool, thereby greatly facilitating the user assembling and disassembling the chair. In addition, the armrest frame 2, the seat frame 3 and the backrest frame 1 are detached from and laminated with each other before assembly so as to reduce the whole volume of the chair and to decrease the cost of packaging, storage and transportation of the chair.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A chair, comprising:

a backrest frame;

an armrest frame detachably mounted on the backrest frame;

a seat frame detachably mounted between the backrest frame and the armrest frame;

wherein the armrest frame includes two side support racks each detachably mounted on the backrest frame;

each of the two side support racks of the armrest frame has a first section detachably mounted on the backrest frame and a second section which is perpendicular to the first section and detachably connected with the seat frame;

the first section of each of the two side support racks has an end face provided with a screw bore;

the backrest frame is provided with two fixing holes each aligning with the screw bore of the respective side support rack;

the chair further comprises two threaded fastening knobs each initially extending through a respective one of the fixing holes of the backrest frame and each then screwed into the screw bore of the respective side support rack so that the first section of each of the two side support racks is releasably locked onto the backrest frame;

the second section of each of the two side support racks has an inner side provided with a fixing block which protrudes outward from each of the two side support racks;

the backrest frame has a front side provided with two positioning blocks each of which protrudes outward from the front side of the backrest frame;

the seat frame has four corners supported by the fixing block of each of the two side support racks and the two positioning blocks of the backrest frame;

the seat frame has a bottom provided with four threaded tubes inserted into the fixing blocks of the two side support racks and the two positioning blocks of the backrest frame respectively;

the chair further comprises four threaded locking knobs screwed into the threaded tubes of the seat frame respectively and abutting the fixing blocks of the two side support racks and the two positioning blocks of the backrest frame respectively so that the seat frame is releasably locked onto the fixing blocks of the two side support racks and the two positioning blocks of the backrest frame;

the fixing block of each of the two side support racks is provided with a fixing hole;

each of the positioning blocks of the backrest frame is provided with a positioning hole;

the threaded tubes of the seat frame are fixed in the fixing holes of the fixing blocks and the positioning holes of the positioning respectively.

2. The chair of claim 1, wherein the fixing block of each of the two side support racks is mounted on a middle position of the second section;

the fixing block of each of the two side support racks is perpendicular to each of the two side support racks;

the fixing block of each of the two side support racks is located under the seat frame to support the seat frame.

3. The chair of claim 1, wherein each of the fixing holes of the backrest frame is formed on an upper portion of the backrest frame.

4. The chair of claim 1, wherein the backrest frame is detachably mounted between the two side support racks of the armrest frame.

5. The chair of claim 1, wherein each of the two positioning blocks of the backrest frame is mounted on a lower portion of the backrest frame;

each of the two positioning blocks of the backrest frame is perpendicular to the backrest frame;

each of the two positioning blocks of the backrest frame is located under the seat frame to support the seat frame.

6. The chair of claim 1, wherein the seat frame is located between the two side support racks of the armrest frame;

each of the four threaded tubes is perpendicular to the seat frame and is directed downward;

each of the four threaded locking knobs is directed upward.

7. The chair of claim 1, wherein each of the two side support racks of the armrest frame is a sheet plate.

8. The chair of claim 1, wherein each of the two side support racks of the armrest frame has a substantially inverted L-shaped profile;

the first section and the second section of each of the two side support racks are formed integrally.

9. The chair of claim 1, wherein the backrest frame is a sheet plate.

10. The chair of claim 1, wherein the backrest frame has a substantially inverted U-shaped profile.

11. The chair of claim 1, wherein the seat frame is a sheet plate.

12. The chair of claim 1, wherein the seat frame has a substantially square profile.

* * * * *